US006076413A

United States Patent [19]

Verot et al.

[11] Patent Number: 6,076,413

[45] Date of Patent: Jun. 20, 2000

[54] MOTOR VEHICLE STARTER WITH AN EPICYCLIC REDUCING GEAR TRAIN INCLUDING A TORQUE LIMITING DEVICE

[75] Inventors: Jacques Verot; Charles Girardot, both of Lyons, France

[73] Assignee: Valeo Equipements Electriques Moteur, Creteil, France

[21] Appl. No.: 09/004,868

[22] Filed: Jan. 9, 1998

[30] Foreign Application Priority Data

Jan. 16, 1997 [FR] France ..... 97 00512

[51] Int. Cl.[7] ..... F02N 11/00

[52] U.S. Cl. ..... 74/7 E; 74/7 C; 464/42; 464/46

[58] Field of Search ..... 74/7 E, 6, 7 C, 74/7 R; 192/56.55, 56.6; 464/42, 45, 46, 30

[56] References Cited

U.S. PATENT DOCUMENTS

| | | | |
|---|---|---|---|
| 3,249,187 | 5/1966 | McDowall | 192/48 |
| 3,664,201 | 5/1972 | Vogel et al. | 74/7 R |
| 3,851,532 | 12/1974 | Pflüger et al. | 74/7 A |
| 4,635,489 | 1/1987 | Imamura et al. | 74/7 E |
| 4,907,685 | 3/1990 | Landolt | 192/485 |
| 5,241,871 | 9/1993 | McKnight, III et al. | 74/7 C |
| 5,596,902 | 1/1997 | McMillen | 74/7 C |

FOREIGN PATENT DOCUMENTS 0 529 456 3/1993 European Pat. Off. .

OTHER PUBLICATIONS

Patent Abstracts of Japan, vol. 018, No. 332 (E–1567), Jun. 23, 1994 & JP 06 078495 (Nippondenso Co Ltd), Mar. 18, 1994.

French Search Report dated Sep. 26, 1997.

*Primary Examiner*—David M. Fenstermacher

*Attorney, Agent, or Firm*—Morgan & Finnegan, L.L.P.

[57] ABSTRACT

A starter for a motor vehicle comprises an electric motor having an output shaft which drives a coaxial starter head through a speed reducer. The speed reducer incorporates an epicyclic gear train, including a cylindrical casing within which the internally toothed crown wheel of the epicyclic gear train is mounted in rotation. The crown wheel is coupled in rotation to the casing through a friction type torque limiting device, which is interposed axially between the crown wheel and a transverse plate of the casing. The torque limiting device includes at least one annular transverse friction surface of the crown wheel, which is biased elastically into axial engagement against a reaction surface coupled in rotation to the casing.

21 Claims, 1 Drawing Sheet

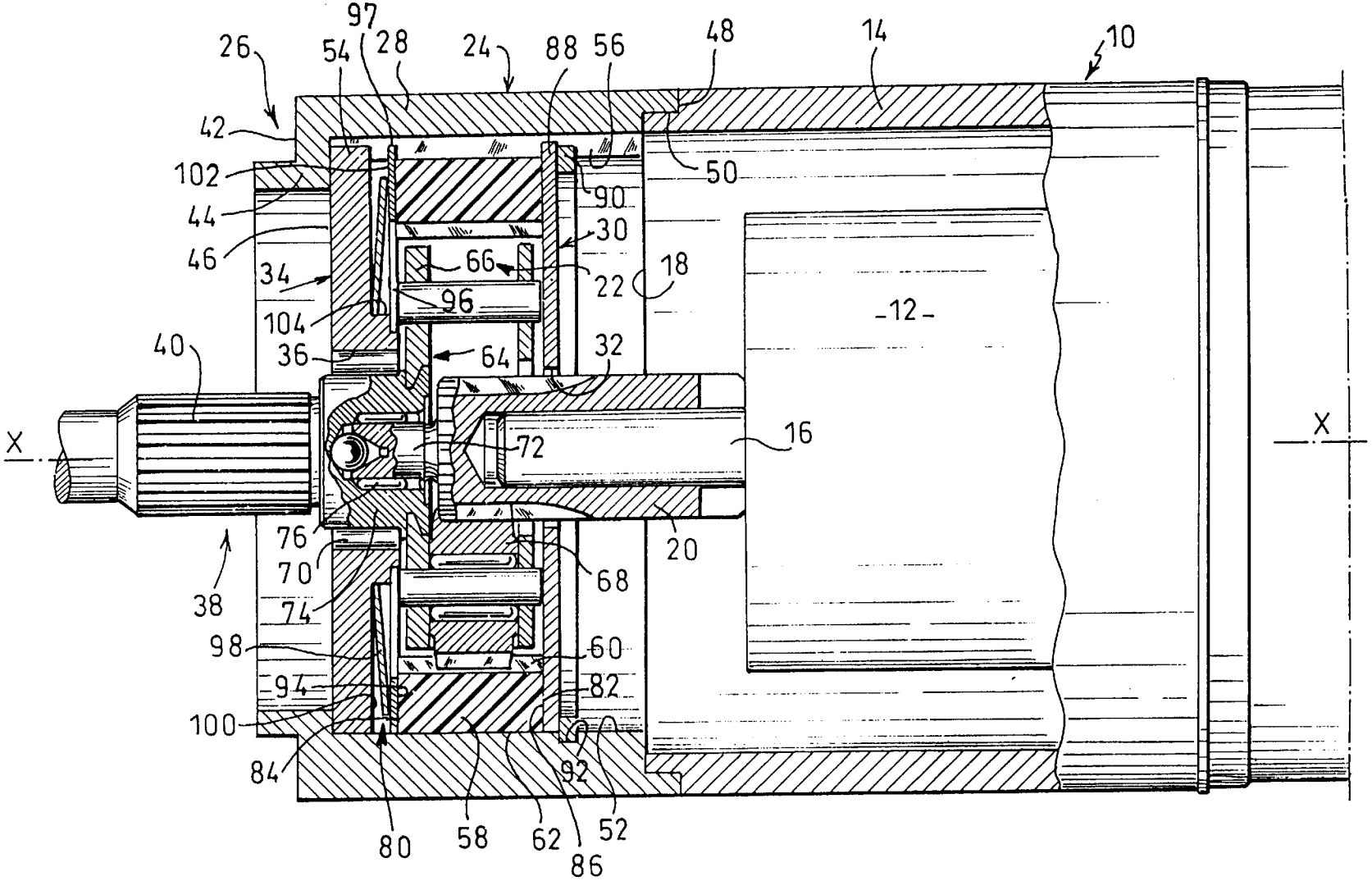
X
10
14
12
16
48
50
18
20
56
90
30
22
32
68
60
82
52
88
92
86
62
24
66
64
72
58
28
96
80
97
54
104
36
76
70
74
94
84
26
42
102
44
46
34
38
98
100
40
X

MOTOR VEHICLE STARTER WITH AN EPICYCLIC REDUCING GEAR TRAIN INCLUDING A TORQUE LIMITING DEVICE

FIELD OF THE INVENTION

The present invention relates to motor vehicle starters, and more particularly to the type of starter having an electric motor, the output shaft of which drives in rotation a starter head coaxial with the motor, through an interposed speed reducer which includes an epicyclic gear train.

BACKGROUND OF THE INVENTION

In order to limit the value of the maximum torque that can be transmitted between the output shaft of the electric motor and the starter output shaft which carries the starter head, it is known per se to provide a torque limiting device. For this purpose it has previously been proposed, for example in Japanese patent specification JP 06/078 495A, to provide a starter in which the epicyclic gear train comprises a cylindrical casing, in which the crown, which has an internal set of teeth, is mounted for rotation, the starter being of a type in which the crown wheel is coupled in rotation to the casing through a torque limiting device of a friction type which is interposed axially between the crown wheel and a transverse plate of the casing.

In that document, the friction ring comprises an annular friction disc which is coupled in rotation to the crown wheel, and which is in axial engagement against the internal face of one of the transverse plates of the casing, against which the friction disc is biased axially by a frusto-conical ring. That design therefore calls for at least two additional components, as compared with an epicyclic gear train having no torque limiting device, that is to say the friction ring and the frusto-conical resilient ring.

Apart from the large number of components involved, the design proposed in the above mentioned Japanese patent specification complicates the design of the crown wheel of the epicyclic gear train, increases the overall axial size of the epicyclic gear train, and makes the assembly of the different components of the starter particularly complex.

DISCUSSION OF THE INVENTION

An object of the invention is to propose a new design for a starter of the general type mentioned above, which overcomes the drawbacks just mentioned.

According to the invention, a starter for a motor vehicle, is provided comprising an electric motor, the output shaft of which drives a coaxial starter head in rotation through an interposed speed reducer having gear wheels in an epicyclic gear train which includes a cylindrical casing, within which the crown wheel, having internal teeth, of the epicyclic gear train is mounted for rotation, the crown wheel is coupled in rotation to the casing through a friction type torque limiting device, which is interposed axially between the crown wheel and a transverse plate of the casing, wherein the torque limiting device comprises at least one transverse annular friction surface of the crown wheel, which is biased axially into axial engagement against a reaction surface which is coupled in rotation to the casing.

Preferably, the reaction surface is the internal face of a transverse plate of the casing. Preferably, the annular rear transverse face of the crown wheel is in axial engagement against the internal surface of the annular rear plate of the casing, through which the free end of the shaft of the motor extends, the motor shaft driving the sun wheel of the epicylic gear train in rotation.

In preferred embodiments of this last mentioned arrangement, a resilient member is mounted in axial compression between the annular front transverse surface of the crown wheel and the internal face of the front plate of the casing, through which the output shaft of the speed reducer extends, the latter output shaft being coupled in rotation to the planet wheel carrier of the epicyclic gear train. Preferably, the two annular transverse surfaces of the crown wheel constitute two friction surfaces of the torque limiting device, and the annular front transverse surface of the crown wheel is in axial engagement against the annular rear surface of a thrust ring, which is coupled in rotation to the casing and is mounted for sliding axial movement with respect to the casing, the thrust ring having an annular front face which constitutes a surface for engagement by the resilient member.

Preferably, the resilient member is a frusto-conical resilient ring.

According to a preferred feature of the invention, the internally toothed crown wheel is made of a material having good friction characteristics and good resistance to wear.

According to another preferred feature of the invention, the casing includes a cylindrical annular skirt portion having an open rear end, and a rear plate which is an annular rear plate or disc having a central hole through which the drive shaft of the motor extends, the rear plate being retained axially within the casing and immobilized against rotation with respect to the casing. With this arrangement, preferably, the rear disc is retained within the casing by a retaining abutment ring which is fitted in an internal radial groove of the skirt portion of the casing.

In preferred embodiments of the invention, the casing has a front plate which is an annular front plate or disc having a central hole through which the output shaft of the speed reducer extends, the front plate bearing axially against an internal radial shoulder of the skirt portion of the casing. With this arrangement, preferably, the central hole in the front disc of the casing receives a bearing for guiding the output shaft of the speed reducer in rotation.

In preferred embodiments of the invention, the rear end of the skirt portion includes a surface for centering the casing on the stator of the electric motor.

In preferred embodiments of the invention where the resilient member is a frusto-conical resilient ring, with the starter output shaft extending through a central hole in the annular front disc which constitutes the front plate of the casing, and in which the front plate bears axially against a radial shoulder of the skirt portion of the casing, the inner face of the front disc includes a cylindrical surface for centering the resilient ring.

Preferably, the front disc is immobilized against rotation with respect to the skirt portion of the casing.

In preferred embodiments incorporating the appropriate features, each of the front disc and the rear disc includes a radial lug, and the skirt portion of the casing has an axial groove in which the radial lugs are received to immobilize the front and rear discs against rotation with respect to the casing.

Further features and advantages of the invention will appear more clearly on a reading of the following detailed description of a preferred embodiment of the invention, which is given by way of non-limiting example only and with reference to the accompanying drawing.

BRIEF DESCRIPTION OF THE DRAWING

The drawing is a view in axial cross section showing part of the electric motor of a starter, associated with its epicyclic gear train, which includes a torque limiting device in accordance with the invention.

DESCRIPTION OF A PREFERRED EMBODIMENT OF THE INVENTION

The drawing shows an electric motor 10 of a motor vehicle starter (which is not shown in detail), the rotor 12 of which is mounted in rotation about an axis X—X, within a casing or stator 14, the two elements 12 and 14 being shown diagrammatically in the drawing. The electric motor 10 has an output shaft 16 which is coupled in rotation to the rotor 12 and which projects axially beyond the front face 18 of the stator 14. The output shaft 16 drives in rotation a pinion 20, which is the sun wheel of an epicyclic gear train 22 arranged inside the casing 24 of a speed reducer 26 associated with the electric motor 10.

The casing 24 consists essentially of a cylindrical annular skirt portion 28, a rear transverse plate 30 in the form of a disc, having a central hole 32 for passage of the sun wheel 20 and output shaft 16, and a front transverse plate 34 having a central hole 36 for passage of the output shaft 38 of the speed reducer 26, which is arranged to drive in rotation the starter head (not shown) of the starter, via splines 40.

The cylindrical annular skirt portion 28 of the casing 24 includes, close to its front axial end 42, an internal radial shoulder 44, against which the outer face 46 of the front plate 34 bears axially. The rear axial end 48 of the skirt portion 28 includes a surface 50 for centering the skirt portion 28 on a complementary portion of the front end of the stator 14 of the electric motor 10. The skirt portion 28 is fixed axially to the stator 14 by a series of ties which are not shown in the drawing.

The annular cylindrical skirt portion 28 of the casing 24 has an internal bore 52, into which the front plate 34 is introduced axially. The front plate 34 is held against rotation with respect to the casing 24 by means of an external radial stop lug 54, which is received axially in an axial groove 56 formed in the bore 52. This groove 56 is open in the open rear axial end 48 of the skirt portion 28.

The epicyclic gear train 22 includes an annular crown wheel 58, having internal teeth 60 and an outer cylindrical surface 62, which is mounted for rotation within the bore 52 of the skirt portion 28. The epicyclic gear train 22 also includes a planet wheel carrier 64 which is coupled in rotation to the starter output shaft 38, and which consists of two plates 66 which carry toothed planet wheels 68 for rotation in the carrier. The planet wheels 68 cooperate with the internal teeth 60 of the crown wheel 58, and with the external teeth of the sun wheel 20.

The output shaft 38 is mounted for rotation in the central hole 36 of the front transverse plate 34, by means of a needle bearing with needles 70, while the free front end 72 of the sun wheel 20 is mounted for rotation within the rear end 74 of the output shaft 38, with a further set of needles 76 interposed.

The toothed crown wheel 58 is coupled in rotation to the skirt portion 28 of the fixed casing 24, through a friction type torque limiting device 80. The crown wheel 58 is one of the components of this torque limiting device. For this purpose, the crown wheel 58 is made of a material having good friction characteristics and high resistance to frictional wear. This material may for example be a suitable filled plastics material.

The toothed crown wheel 58 is bounded laterally, i.e. transversely to the axis of rotation X—X, by two transverse annular faces, namely a rear face 82 and a front face 84, which constitute two annular friction surfaces of the torque limiting device 80. The annular rear transverse face 82 is in axial engagement against the inner surface 86 (in facing relationship with it) of the rear plate 30 of the casing 24. This transverse rear plate 30 is arranged within the bore 52 of the skirt portion 28, in which it is immobilized against rotation by means of an external radially oriented stop lug 88, which is received in the groove 56 of the skirt portion 28. The rear plate 30 is retained axially within the skirt portion 28 by means of a retaining ring 90, which is fitted into an internal radial groove 92 in the bore 52 of the skirt portion 28.

The annular front transverse friction face 84 of the crown wheel 58 is in axial engagement against the annular rear face 94 of the thrust ring 96, which is mounted within the bore 52, and which is immobilized against rotation with respect to the casing 24 by means of an external, radially oriented, stop lug 97 received in the axial groove 56.

A resilient member 98, in the form of a frusto-conical ring, is mounted in axial compression between the internal axial face 100 of the front transverse plate 34 and the annular front face 102 of the thrust ring 96. The resilient ring 98 is centered on a cylindrical surface 104 of the transverse front plate 34, which extends radially inwardly from it. The resilient ring 98 thus applies an axial compression force to the assembly consisting of the crown wheel 58, the transverse rear plate 30 and the thrust ring 96, against the abutment which consists of the retaining ring 90.

The value of the axial resilient force applied by the resilient ring 98 to this assembly determines the value of the maximum permissible torque exerted by the torque limiting device 80, in association with the value of the coefficients of friction that exist between the transverse faces 82 and 84 of the crown wheel 58 and the annular faces (in facing relationship) 86 and 94 of the rear plate 30 and of the thrust ring 96.

The design according to the invention is particularly compact in the axial direction, in that it does not call for the provision of any particular friction disc or ring, this function being provided by the toothed crown wheel 58 itself.

Assembly of the components is particularly easy, and the assembly of the components of the epicyclic gear train 22 and of the torque limiting device 80 can be carried out within the casing 24, this assembly being retained in place by means of the retaining ring 90. The resulting sub-assembly can then be fitted on the stator 14 of the motor 10, with the sun wheel 20, associated in rotation with the output shaft 16 of the motor 10, extending into the interior of the speed reducer 26.

When the reaction torque which is applied to the output shaft 40 by the engine of the vehicle, via the starter head, exceeds the limiting value permitted by the torque limiting device 80, for example in the event of a torsional shock in the engine, the forces whereby the crown wheel 58 adheres on the rear plate 30 and the thrust ring 96 are no longer large enough to immobilize the crown wheel 58 against rotation with respect to the casing 24 of the speed reducer 26. Thus, the crown wheel 58 is set in rotation within the casing 24, and dissipates the excess mechanical energy by friction.

What is claimed is:

1. A motor vehicle starter, comprising: an electric motor having a motor output shaft; a speed reducer coupled to the motor output shaft, wherein the motor output shaft drives the speed reducer; and a start output shaft for driving a starter head in rotation, the speed reducer comprising an epicyclic gear train including a crown wheel having internal teeth and at least one annular friction surface on a transverse friction face of the crown wheel, a cylindrical casing including a transverse plate, and a friction type torque limiting device for coupling the crown wheel in rotation to the casing, the torque limiting device being interposed axially between the crown wheel and the transverse plate, and including the at least one friction surface of the crown wheel, the at least one friction surface being biased into axial engagement against a reaction surface, the reaction surface being coupled to the casing.

2. A start according to claim 1, wherein the casing includes a transverse plate having an internal surface defining the reaction surface.

3. A starter according to claim 2, wherein the transverse plate is a rear plate of the casing, the at least one friction surface of the crown wheel including an annular rear transverse surface in axial engagement against the internal face of the rear plate of the casing, the rear plate of the casing having a through hole, the motor output shaft extending through the hole and having a free end, the epicyclic gear train further including a sun wheel coupled to the free end of the motor output shaft, wherein the motor output shaft rotates said sun wheel.

4. A starter according to claim 3, wherein the at least one transverse surface of the crown wheel further includes a front friction surface, the casing further includes a front plate having an internal face and a through hole, the starter output shaft extends through the through hole in the front plate, the epicyclic gear train further includes a planet wheel carrier coupled in rotation to the starter output shaft, the speed reducer further includes an elastic member mounted in axial compression between the front surface of the crown wheel and the internal face of the front plate.

5. A starter according to claim 4, wherein a plurality of transverse surfaces of the crown wheel constitute a plurality of friction surfaces of the torque limiting device, the speed reducer further including a thrust ring being coupled in rotation to the casing and for relative axial sliding movement relative to the casing, the thrust ring having an annular rear face and an annular front face constituting an engagement surface for the resilient member, the front transverse surface of the crown wheel being in axial engagement against the rear face of the thrust ring.

6. A starter according to claim 4, wherein the resilient member is a frusto-conical resilient ring.

7. A starter according to claim 6, wherein the casing has a cylindrical annular skirt portion with an open rear end and a rear plate in the form of an annular disc having a central hole, the motor shaft extending through the central hole, the starter further including a retaining member for retaining the rear plate within the casing and immobilizing the rear plate against rotation with respect to the casing, the casing further including a transverse front plate, said front plate being an annular disc with a central hole, the starter output shaft extending through the central hole of the front plate, the skirt portion having an internal radial shoulder, the front plate bearing axially against the shoulder, the internal surface of the front disc defining a cylindrical surface for centering the resilient ring.

8. A starter according to claim 1, wherein the casing has a cylindrical annular skirt portion with an open rear end and a rear plate in the form of an annular disc having a central hole, the motor shaft extending through the central hole, the starter further including a retaining member for retaining the rear plate within the casing and immobilizing the rear plate against rotation with respect to the casing.

9. A starter according to claim 8, wherein the skirt portion has an internal radial groove, the retaining member comprising a retaining abutment ring fitted in the internal radial groove.

10. A starter according to claim 8, wherein the casing further includes a transverse front plate, said front plate being an annular disc with a central hole, the starter output shaft extending through the central hole of the front plate, the skirt portion having an internal radial shoulder, the front plate bearing axially against the shoulder.

11. A starter according to claim 10, further including a bearing in the central hole of the front plate, the starter output shaft being mounted in the bearing.

12. A starter according to claim 10, wherein said front plate is immobilized against rotation with respect to the skirt portion of the casing.

13. A starter according to claim 12, wherein the casing includes a transverse plate having an internal surface defining the reaction surface, the transverse plate being a rear plate of the casing, the at least one friction surface of the crown wheel including an annular rear transverse surface in axial engagement against the internal face of the rear plate of the casing, the rear plate of the casing having a through hole, the motor output shaft extending through the hole and having a free end.

14. A starter according to claim 13, wherein the epicyclic gear train further includes a sun wheel coupled to the free end of the motor output shaft, the motor output shaft rotating said sunwheel.

15. A starter according to claim 14, wherein the at least one transverse surface of the crown wheel further includes a front friction surface and wherein the casing includes a front plate having an internal face and a through hole, the starter output shaft extending through the through hole in the front plate.

16. A starter according to claim 15, wherein the epicyclic gear train further includes a planet wheel carrier coupled in rotation to the starter output shaft.

17. A starter according to claim 16, wherein the speed reducer further includes an elastic member mounted in axial compression between the front surface of the crown wheel and the internal face of the front plate, and wherein a plurality of transverse surfaces of the crown wheel constitute a plurality of friction surfaces of the torque limiting device.

18. A starter according to claim 17, wherein the speed reducer further including a thrust ring, the thrust ring being mounted for rotation in the casing and for relative axial sliding movement with respect to the casing, the thrust ring having an annular rear face and an annular front face constituting an engagement surface for the resilient member, the front transverse surface of the crown wheel being in axial engagement against the rear face of the thrust ring.

19. A starter according to claim 18, wherein each of the front and rear discs has a radial lug, the skirt portion having an axial groove, the radial lugs being received in the axial groove for immobilizing the front and rear discs against rotation with respect to the casing.

20. A starter according to claim 8, wherein the motor has a stator, the rear end of the skirt portion having a surface for centering the casing on the stator.

21. A starter according to claim 1, wherein the crown wheel is made of a high friction, wear resistant material.

* * * * *